United States Patent [19]

Converse et al.

[11] 4,371,021

[45] Feb. 1, 1983

[54] BOX TOP OPENER

[76] Inventors: Gregg A. Converse; Maurice Converse, both of 1311 Briarhill Dr., Akron, Ohio 44313

[21] Appl. No.: 189,882

[22] Filed: Sep. 23, 1980

[51] Int. Cl.[3] ..... B67B 7/00

[52] U.S. Cl. ..... 145/21; 7/151; 7/164; 7/169

[58] Field of Search ..... 145/21; 7/151, 164, 7/166, 169

[56] References Cited

U.S. PATENT DOCUMENTS

| | | | |
|---|---|---|---|
| 96,700 | 11/1869 | Howard | 145/21 |
| 394,547 | 12/1888 | Thacker | 145/21 |
| 745,984 | 12/1903 | Alkire | 7/164 |
| 1,182,593 | 5/1916 | Sommer | 145/21 |
| 1,360,321 | 11/1920 | Rosenfeld | 7/151 |
| 1,628,650 | 5/1927 | Buchanan | 7/169 |
| 2,106,749 | 2/1938 | Knight | 7/164 |
| 2,323,621 | 7/1943 | Penney | 7/151 |
| 2,622,781 | 12/1952 | Polson | 7/151 |
| 4,034,595 | 7/1977 | Smith | 7/151 |

FOREIGN PATENT DOCUMENTS

| | | | |
|---|---|---|---|
| 199229 | 4/1920 | Canada | 7/169 |

*Primary Examiner*—Stephen G. Kunin
*Assistant Examiner*—J. T. Zatarga
*Attorney, Agent, or Firm*—Sughrue, Mion, Zinn, Macpeak & Seas

[57] ABSTRACT

The box top opener is of one piece molded plastics material and includes an elongated reinforced handle portion having reinforced box top gripping jaws extending from one end thereof. The jaws are comprised of a pair of flat parallel closely spaced apart plates adapted to receive the box top therebetween. The upper jaw has a rectangular configuration and the lower jaw has a triangular configuration with the edges thereof beveled to facilitate insertion under the box top whereby upon lifting of the handle the portion of the box top engaged between the jaws will be separated from the sides of the box and lifted upwardly to provide access to the contents of the box.

2 Claims, 4 Drawing Figures

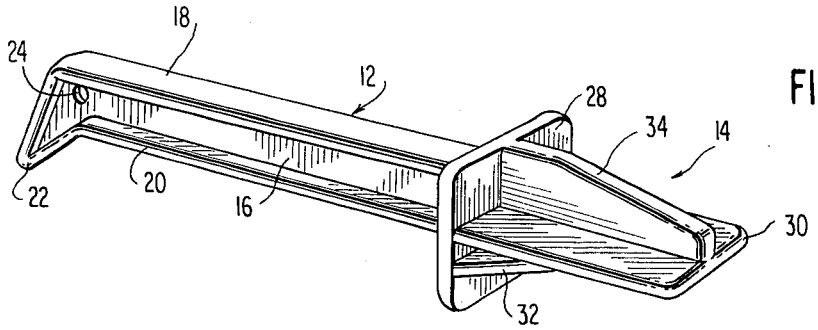
FIG. 1
FIG. 2
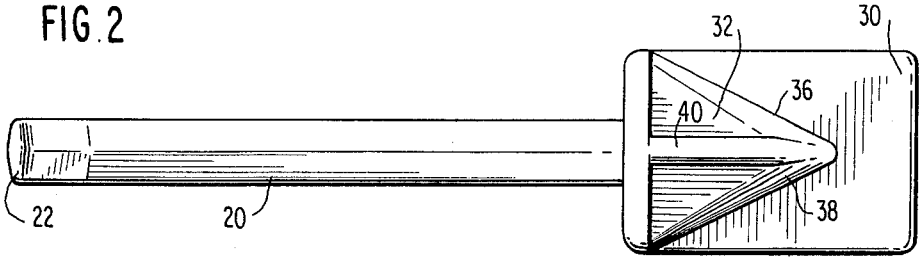
FIG. 3
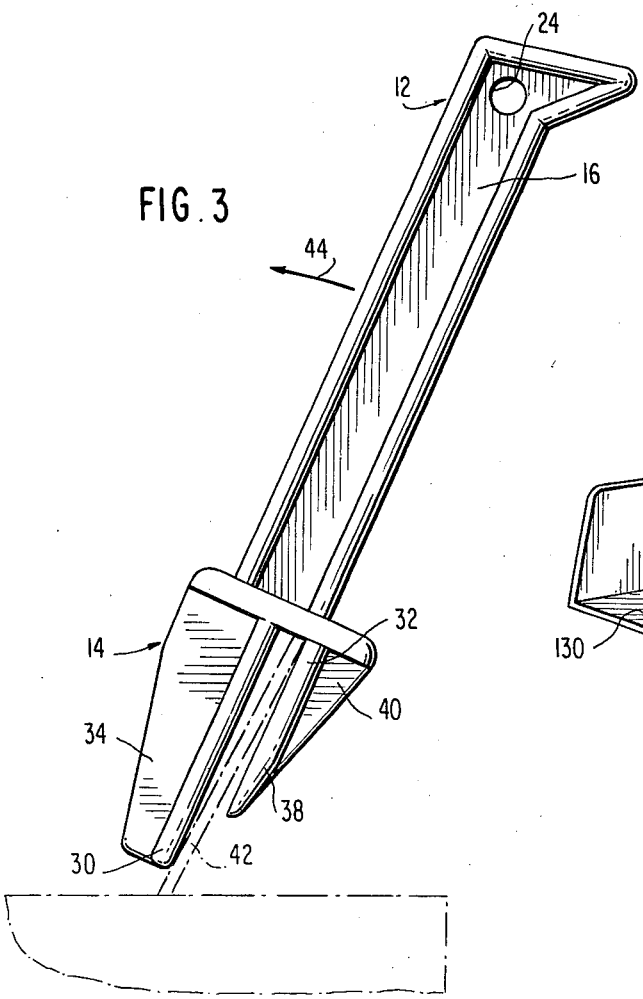
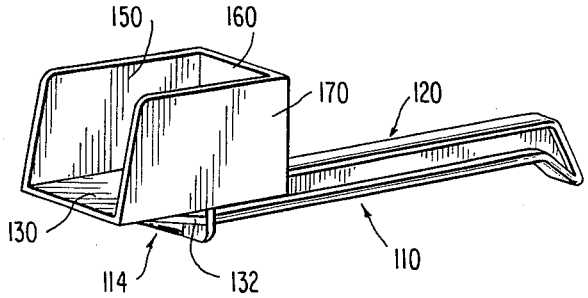
FIG. 4

BOX TOP OPENER

BACKGROUND OF THE INVENTION

The present invention is directed to a box top opener and more specifically to a one-piece molded plastic opener suitable for gripping one end of a box top whereby the end of the box top may be pried up and bent back to facilitate pouring out of the contents of the box.

Many boxes on the market today containing granular materials, such as soap or the like, have the upper end thereof enclosed by overlapping flaps which are adhesively secured together. Such boxes usually have two parallel dotted lines or score lines along the edges of the top extending inwardly from one end of the box and directions stating that the top of the box should be torn back along the two parallel dotted lines or score lines. Some boxes are further provided with a dot on the side of the box adjacent the top edge between two angular intersecting score lines which define a triangular flap which must be pressed inwardly prior to tearing the end of the top upwardly. Depending upon the thickness of the stock material of the box and the effectiveness of the score lines, if any, the opening of such a box can prove to be extremely frustrating and difficult especially for people having very little strength in their fingers or suffer from arthritis. Women with long fingernails often complain about opening boxes of this type since they frequently break their fingernails in the process.

SUMMARY OF THE INVENTION

The present invention is directed to a unique box top opener suitable for opening boxes of the foregoing type. The box top opener is provided with two rigid spaced apart jaws at one end of a handle for gripping the box top to facilitate tearing back one end of the box top in an effortless and efficient manner.

The box top opener according to the present invention is a one-piece molded plastic device comprised of a handle portion and a top gripping portion at one end thereof. The top gripping portion is comprised of a lower triangular jaw having beveled edges for easy insertion beneath the box top while the upper jaw is comprised of a broad flat member adapted to overlie the upper surface of the box top. Both the upper and lower jaws are provided with reinforcing ribs to provide added strength and prevent bending or breaking of the jaws while opening a box top. The upper surface of the upper jaw may also be provided with upstanding walls to define a measuring compartment to assist in accurate dispensing of the contents of the box.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is a perspective view of the box top opener according to the present invention.

FIG. 2 is a bottom plan view of the box top opener according to the present invention.

FIG. 3 is a side elevation view of the box top opener according to the present invention in engagement with a box top.

FIG. 4 is a modified form of the box top opener according to the present invention having a measuring compartment integral therewith.

DETAILED DESCRIPTION OF THE INVENTION

The box top opener 10 is of one-piece molded plastics material which will provide a rigid high strength structure. The box top opener is comprised of a handle portion 12 and a gripping portion 14 at one end thereof. The handle portion 12 is provided with a flat elongated central web portion 16 having relatively thick reinforcing flanges 18 and 20 along opposite edges thereof. The end of the handle opposite the gripping portion is provided with a triangular shaped offset portion 22 suitable for pushing in the triangular flap defined by perforated lines adjacent the top side portion of a box. An aperture 24 is provided through the web 16 at the end thereof opposite the gripping portion to facilitate the hanging up of the opener.

The gripping portion 14 is comprised of a transversely extending stop plate 28 having upper and lower jaws 30 and 32 protruding forwardly thereof in spaced apart parallel relation. The upper jaw 30 is comprised of a flat rectangular plate adapted to engage the upper outer surface of the box top and is reinforced by an integral rib 34 extending between the stop plate 28 and the upper surface of the upper jaw 30. The lower jaw 32 has a flat triangular configuration with the lower edges beveled at 36 and 38 to facilitate sliding the lower jaw beneath the box top. The lower jaw is strengthened by means of a rib 40 extending between the under surface of the jaw 32 and the stop plate 28.

The operation of the device is best understood from FIG. 3 of the drawings wherein the lower jaw 32 has been forced under the box top 42 from the side of the box. With the box top 42 fully inserted into the gap between the two jaws 30 and 32 the handle portion 12 is raised in the direction of the arrow 44 to lift the top 42 upwardly while simultaneously severing the connections along the front and rear edges of the top.

In the embodiment shown in FIG. 4, the box top opener 110 is constructed basically the same as in the previous embodiment with a handle portion 120 and a gripping portion 114 having a lower jaw 132 and an upper jaw 130. Additionally, three upstanding walls 150, 160 and 170 are integrally molded with the upper jaw 130 to define a measuring device. After opening the box with the box top opener 110 the contents of the box can then be poured into the measuring device on the upper jaw 130 so that the contents of the box can be accurately dispensed.

While the invention has been particularly shown and described with reference to preferred embodiments thereof, it will be understood by those in the art that the foregoing and other changes in form and details may be made therein without departing from the spirit and scope of the invention.

What is claimed is:

1. A box top opener comprising elongated handle means, flat plate means secured to and extending transversely to the length of said handle means at one end thereof, first and second flat, parallel, closely spaced apart jaws extending perpendicular to said plate means opposite said handle means for receiving a box top therebetween for separating that portion of a box top received therebetween from the sides of the box and bending said portion upwardly to open one corner of the box to provide access to the contents thereof, said first jaw being comprised of a substantially rectilinear plate having a width and length sufficient to overlie a substantial portion of the upper surface of the box top and said second jaw being comprised of a triangular plate the base of which is equal to the width of the upper plate and the length of which is greater than half the length but considerably less than the full length of said first plate, the edges of said triangular second plate remote from said first plate being beveled to facilitate insertion of said second plate beneath a box top and reinforcing means secured to and extending perpendicularly to said plate means and said jaws for reinforcing said jaws against bending movement relative to said plate means.

2. A box top opener as set forth in claim 1, wherein said opener is constructed in one piece of molded plastics material.

* * * * *